US009224572B2

(12) United States Patent
Frontera et al.

(10) Patent No.: US 9,224,572 B2
(45) Date of Patent: Dec. 29, 2015

(54) X-RAY TUBE WITH ADJUSTABLE ELECTRON BEAM

(71) Applicant: General Electric Company, Schenectady, NY (US)

(72) Inventors: Mark Alan Frontera, Niskayuna, NY (US); John Scott Price, Niskayuna, NY (US); Sergio Lemaitre, Milwaukee, WI (US); Yun Zou, Niskayuna, NY (US); Peter Andras Zavodszky, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 427 days.

(21) Appl. No.: 13/718,672

(22) Filed: Dec. 18, 2012

(65) Prior Publication Data

US 2014/0169530 A1 Jun. 19, 2014

(51) Int. Cl.
*H01J 35/14* (2006.01)
*H01J 35/04* (2006.01)

(52) U.S. Cl.
CPC ..... *H01J 35/14* (2013.01); *H01J 35/045* (2013.01)

(58) Field of Classification Search
None
See application file for complete search history.

(56) References Cited

U.S. PATENT DOCUMENTS

| | | | | |
|---|---|---|---|---|
| 2,559,526 A | | 7/1951 | Van De Graaff et al. | |
| 3,710,176 A | | 1/1973 | Schlesinger | |
| 3,784,815 A | * | 1/1974 | Coates et al. | 850/55 |
| 4,213,048 A | | 7/1980 | Quang et al. | |
| 4,458,180 A | | 7/1984 | Sohval et al. | |
| 4,631,742 A | * | 12/1986 | Oliver | 378/113 |
| 4,912,367 A | | 3/1990 | Schumacher et al. | |
| 5,199,054 A | | 3/1993 | Adams et al. | |
| 5,332,945 A | | 7/1994 | True | |
| 5,438,605 A | | 8/1995 | Burke et al. | |
| 5,617,464 A | * | 4/1997 | Mika et al. | 378/137 |
| 5,812,632 A | * | 9/1998 | Schardt et al. | 378/137 |
| 6,091,799 A | * | 7/2000 | Schmidt | 378/137 |

(Continued)

FOREIGN PATENT DOCUMENTS

| | | |
|---|---|---|
| EP | 2 077 574 A1 | 7/2009 |
| JP | 2007051326 A | 3/2007 |

(Continued)

OTHER PUBLICATIONS

Jack et al.; "A Pulsed X-ray Generator"; (http://iopscience.iop.org/0022-3735/6/2/027); *J. Phys. E: Sci. Instrum.*; vol. 6; pp. 162-164; 1973.

*Primary Examiner* — Andrew Smyth
(74) *Attorney, Agent, or Firm* — Robert M. McCarthy

(57) ABSTRACT

An X-ray tube assembly is provided including an emitter configured to emit an electron beam, an emitter focusing electrode, an extraction electrode, and a downstream focusing electrode. The emitter focusing electrode is disposed proximate to the emitter and outward of the emitter in an axial direction. The extraction electrode is disposed downstream of the emitter and the emitter focusing electrode. The extraction electrode has a negative bias voltage setting at which the extraction electrode has a negative bias voltage with respect to the emitter. The downstream focusing electrode is disposed downstream of the extraction electrode, and has a positive bias voltage with respect to the emitter. When the extraction electrode is at the negative bias voltage setting, the electron beam is emitted from an emission area that is smaller than a maximum emission area from which electrons may be emitted.

22 Claims, 5 Drawing Sheets

(56) References Cited

U.S. PATENT DOCUMENTS

| | | | | |
|---|---|---|---|---|
| 6,094,009 | A | 7/2000 | Goebel | |
| 6,570,165 | B1 | 5/2003 | Engdahl et al. | |
| 6,652,143 | B2 | 11/2003 | Popescu | |
| 6,785,359 | B2 | 8/2004 | Lemaitre | |
| 6,816,573 | B2 | 11/2004 | Hirano et al. | |
| 6,912,268 | B2 | 6/2005 | Price et al. | |
| 6,944,268 | B2 | 9/2005 | Shimono | |
| 7,110,500 | B2 * | 9/2006 | Leek | 378/111 |
| 2002/0180364 | A1 | 12/2002 | Ratzinger et al. | |
| 2003/0099327 | A1 * | 5/2003 | Matsushita et al. | 378/138 |
| 2004/0240616 | A1 | 12/2004 | Qiu et al. | |
| 2007/0053495 | A1 * | 3/2007 | Morton et al. | 378/136 |
| 2008/0043920 | A1 | 2/2008 | Liu et al. | |
| 2008/0067377 | A1 | 3/2008 | Hatakeyama et al. | |
| 2008/0095317 | A1 | 4/2008 | Lemaitre | |
| 2008/0187093 | A1 | 8/2008 | Price et al. | |
| 2010/0046712 | A1 | 2/2010 | Behling | |
| 2010/0061516 | A1 | 3/2010 | Freudenberger et al. | |
| 2010/0128846 | A1 | 5/2010 | Balakin | |
| 2011/0038460 | A1 | 2/2011 | Grasruck et al. | |
| 2011/0116593 | A1 * | 5/2011 | Zou et al. | 378/16 |
| 2011/0142193 | A1 * | 6/2011 | Frontera et al. | 378/16 |
| 2014/0126704 | A1 * | 5/2014 | Zou et al. | 378/197 |

FOREIGN PATENT DOCUMENTS

| | | | |
|---|---|---|---|
| WO | WO 2006/064403 | A2 | 6/2006 |
| WO | WO 2007/135614 | A1 | 11/2007 |
| WO | WO 2009/127995 | A1 | 10/2009 |

* cited by examiner

X-RAY TUBE WITH ADJUSTABLE ELECTRON BEAM

BACKGROUND

X-ray tubes may be used in a variety of applications to scan objects and reconstruct one or more images of the object. For example, in computed tomography (CT) imaging systems an X-ray source emits a fan-shaped beam or a cone-shaped beam toward a subject or an object, such as a patient or a piece of luggage. The terms "subject" and "object" may be used to include anything that is capable of being imaged. The beam, after being attenuated by the subject, impinges upon an array of radiation detectors. The intensity of the attenuated beam radiation received at the detector array is typically dependent upon the attenuation of the X-ray beam by the subject. Each detector element of a detector array produces a separate electrical signal indicative of the attenuated beam received by each detector element. The electrical signals are transmitted to a data processing system for analysis. The data processing system processes the electrical signals to facilitate generation of an image.

Generally speaking, in CT systems, the X-ray source and the detector array are rotated about a gantry within an imaging plane and around the subject. Furthermore, the X-ray source generally includes an X-ray tube, which emits the X-ray beam at a focal point. Also, the X-ray detector or detector array in some systems includes a collimator for collimating X-ray beams received at the detector, a scintillator disposed adjacent to the collimator for converting X-rays to light energy, and photodiodes for receiving the light energy from the adjacent scintillator and producing electrical signals therefrom. In other systems, a direct conversion material, such as a semiconductor (e.g., Cadmium Zinc Telluride (CdZnTe)) may be used.

The X-ray tube, for example, may include an emitter from which an electron beam is emitted toward a target. The emitter may be configured as a cathode and the target as an anode, with the target at a substantially higher voltage than the emitter. Electrons from the emitter may be formed into a beam and directed or focused by electrodes and/or magnets. In response to the electron beam impinging the target, the target emits X-rays.

The size of the electron beam may affect resolution. For example, a smaller diameter electron beam may allow generation of higher resolution focal spots. Certain known X-ray tubes have drawbacks regarding electron beam sizing. For instance, conventional X-ray tubes may produce electron beams that have a generally large diameter that inhibits high resolution focal spots. Further, differently configured resolutions of focal spots may be desirable in connection with different applications or uses of X-ray scanning. However, conventional X-ray devices may be limited to a single diameter of electron beam, and thus, a single resolution of focal spots, thereby limiting the usefulness of a given device for different applications or procedures.

BRIEF DESCRIPTION

In one embodiment, an X-ray tube assembly is provided. The X-ray tube assembly includes an emitter, an emitter focusing electrode, an extraction electrode, and a downstream focusing electrode. The emitter is configured to emit an electron beam that defines a downstream direction toward a target. The emitter is disposed proximate an upstream end of the X-ray assembly. The emitter defines a maximum emission area from which the electron beam may be emitted from the emitter. The emitter focusing electrode is disposed proximate the emitter and outward of the emitter in an axial direction. The extraction electrode is disposed proximate the emitter focusing electrode and downstream of the emitter and the emitter focusing electrode. The extraction electrode is configured to surround the electron beam in the axial direction. The extraction electrode has a negative bias voltage setting wherein the extraction electrode has a negative bias voltage with respect to the emitter at the negative bias voltage setting. The downstream focusing electrode is disposed proximate the extraction electrode and downstream of the extraction electrode. The downstream focusing electrode is configured to surround the electron beam in the axial direction. The downstream focusing electrode has a positive bias voltage with respect to the emitter. When the extraction electrode is at the negative bias voltage setting, the electron beam is emitted from an emission area that is smaller than the maximum emission area.

In another embodiment, an X-ray tube assembly is provided. The X-ray tube assembly includes an emitter, a target, an emitter focusing electrode, an extraction electrode, a downstream focusing electrode, and a focusing magnet assembly. The emitter is configured to emit an electron beam that defines a downstream diction. The emitter is disposed proximate an upstream end of the X-ray tube assembly. The target is disposed proximate a downstream end of the X-ray tube assembly and is configured to receive the electron beam emitted from the emitter. The target is configured to provide an X-ray beam responsive to a collision of the electron beam with the target. The emitter focusing electrode is disposed proximate the emitter and outward of the emitter in an axial direction. The extraction electrode is disposed proximate the emitter focusing electrode and downstream of the emitter and the emitter focusing electrode. The extraction electrode is configured to surround the electron beam in the axial direction, and has a negative bias voltage setting, with the extraction electrode having a negative bias voltage with respect to the emitter at the negative bias voltage setting. The extraction electrode also has a positive voltage bias setting at which the extraction electrode has a positive bias voltage with respect to the emitter. The extraction electrode is configured to be movable between the negative bias voltage setting and the positive bias voltage setting. The downstream focusing electrode is disposed proximate the extraction electrode and downstream of the extraction electrode and is configured to surround the electron beam in the axial direction. The downstream focusing electrode has a positive bias voltage with respect to the emitter. The electron beam is emitted from a first emission area when the extraction electrode is at the positive bias voltage setting and from a second emission area when the extraction electrode is at the negative bias voltage setting. The first emission area is larger than the second emission area. The focusing magnet assembly is disposed downstream of the downstream focusing electrode and upstream of the target, and is configured to at least one of focus, deflect, or position the electron beam on the target.

In a further embodiment, a method for providing an electron beam (e.g., an electron beam for X-ray generation) is provided. The method includes emitting an electron beam defining a downstream direction from an emitter toward a target. The emitter defines a maximum emission area from which the electron beam may be emitted from the emitter. The method also includes focusing the electron beam using an emitter focusing electrode. The method also includes applying a negative bias voltage to an extraction electrode through which the electron beam passes. The negative bias voltage has a negative voltage with respect to the emitter. The extraction electrode is disposed proximate the emitter focusing electrode and downstream of the emitter and the emitter focusing electrode. The extraction electrode is configured to surround the electron beam in the axial direction. The method also includes applying a positive bias voltage to a downstream focusing electrode. The positive bias voltage has a positive voltage with respect to the emitter. The downstream focusing electrode is disposed downstream of the extraction electrode and is configured to surround the electron beam in the axial direction. When the extraction electrode has a negative bias voltage applied and the downstream focusing electrode has a positive bias voltage applied, the electron beam is emitted form an emission area that is smaller than the maximum emission area.

DETAILED DESCRIPTION

Figure 1:
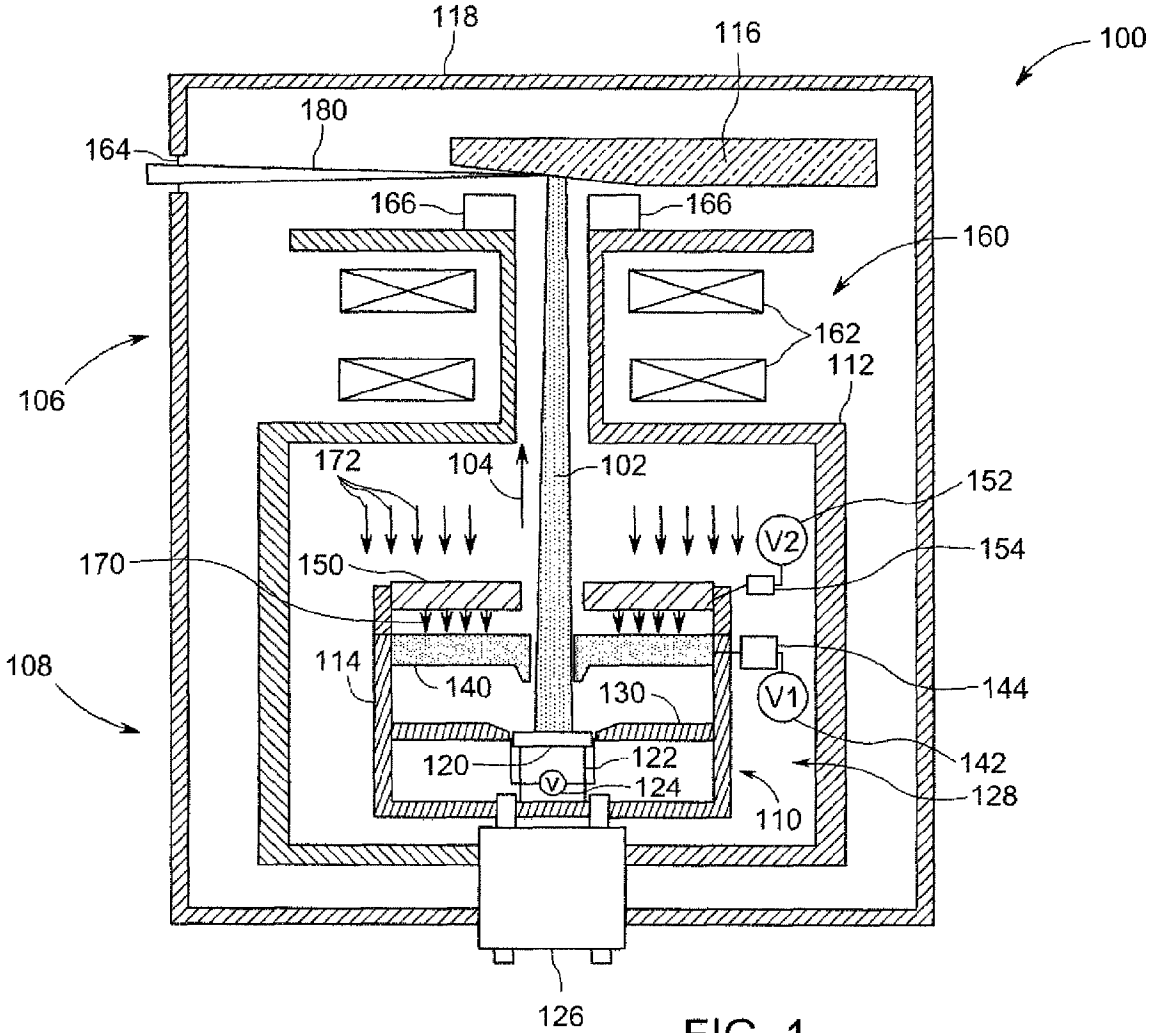
FIG. 1 is a sectional view of an X-ray tube assembly in accordance with various embodiments.

Various embodiments will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors, controllers or memories) may be implemented in a single piece of hardware (e.g., a general purpose signal processor or random access memory, hard disk, or the like) or multiple pieces of hardware. Similarly, any programs may be stand-alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Systems formed in accordance with various embodiments provide an X-ray tube assembly having two or more electrodes, with voltages biased from an emitter, positioned generally directly in front (in the direction of electron beam travel) of the emitter. An extraction electrode having a negative bias voltage relative to the emitter may be disposed in front (or downstream) of the emitter, and a downstream focusing electrode having a positive bias voltage relative to the emitter may be disposed in front (or downstream) of the negatively biased extraction emitter. In some embodiments, an emitter focusing electrode may surround at least a portion of the emitter. By placing the downstream focusing electrode at a relatively high positive bias voltage while maintaining the extraction electrode at a negative bias voltage, emission of electrodes may be suppressed for one or more portions of an emitter surface, a smaller emission area of the emitter may be employed, and a smaller diameter electron beam may be produced compared to conventional systems not employing such a voltage biasing arrangement.

Systems formed in accordance with various embodiments further provide for adjustability in the area of the emitter for which emission is suppressed and the size (e.g., diameter, width, and/or cross-sectional area) of the electron beam. For example, increasing the amplitude of the negative bias voltage applied to the extraction electrode may decrease the size or diameter of the electron beam, and decreasing the amplitude of the negative bias voltage applied to the extraction electrode may increase the size or diameter of the electron beam. In some embodiments, the extraction electrode may be adjusted across a range of bias voltages that include negative and positive bias voltages. For example, the extraction electrode may be set to a maximum negative bias voltage to produce a minimum electron beam diameter, set to a maximum positive bias voltage to produce a maximum electron beam diameter, or adjustably set at various points between the maximum negative bias voltage and the maximum positive voltage bias to produce electron beams sized between the minimum electron beam diameter and the maximum beam diameter. A technical effect of at least one embodiment includes improved adjustability of electron beam sizes. A technical effect of at least one embodiment includes improved adjustability of focal spot sizes for X-ray devices. A further technical effect of at least one embodiment is improved resolution for X-ray imaging. For example, when coupled with a relatively small pixel detector, embodiments provide for finer resolution CT imaging.

FIG. 1 is a sectional view of an X-ray tube assembly 100 formed in accordance with various embodiments. The X-ray tube assembly 100 includes an injector 110 disposed within a vacuum wall 112. The injector 110 may further include an injector wall 114 that encloses various components of the injector 110. In addition, the X-ray tube assembly 100 may also include an anode or target 116. The anode 116 is typically an X-ray target. The injector 110 and the target 116 are disposed within a tube casing 118. In some embodiments, the injector 110 may include at least one cathode in the form of an emitter 120. In some embodiments, the injector 110 may include a Pierce-type cathode. The cathode (e.g., emitter 120) may be directly heated in some embodiments, and indirectly heated in some embodiments. In the illustrated embodiments, the emitter 120 is coupled to an emitter support 122, with the emitter support 122 in turn coupled to the injector wall 114. The emitter 120 may be heated, for example, by passing a relatively large current through the emitter 120. A voltage source 124 may supply this current to the emitter 120. In some embodiments, a current of about 10 amps may be passed through the emitter 120. The emitter 120 may emit an electron beam 102 as a result of being heated by the current supplied by the voltage source 124. As used herein, the term "electron beam" may be used to refer to as a stream of electrons that have substantially similar velocities. The electron beam 102 defines a downstream direction 104 as the direction from the emitter 120 to the target 116. The X-ray assembly 100 includes a downstream end 106 and an upstream end 108, with the emitter 120 disposed proximate the upstream end 108 and the target 116 disposed proximate the downstream end 106. The electron beam 102 may a substantially uniform width, diameter, or cross-section along one or more portions of the length of the electron beam 102. In practice, other profiles may be employed. For example, the electron beam 102 may have a relatively small, substantially continuous taper along the length of the electron beam 102. As another example, the electron beam 102 may be tapered at different rates along different portions of the length of the electron beam.

The electron beam 102 may be directed towards the target 116 to produce X-rays 180. More particularly, the electron beam 102 may be accelerated from the emitter 120 towards the target 116 by applying a potential difference between the emitter 120 and the target 116. In some embodiments, a high voltage in a range from about 40 kiloVolts (kV) to about 450 kV may be applied via use of a high voltage feedthrough 126 to set up a potential difference between the emitter 120 and the target 116, thereby generating a high voltage main electric field 172 to accelerate the electrons in the electron beam 102 towards the target 116. In some embodiments, a high voltage potential difference of about 140 kV may be applied between the emitter 120 and the target 116. It may be noted that in some embodiments, the target 116 may be at ground potential. For example, in some embodiments, the emitter 120 may be at a potential of about −140 kV and the target 116 may be at ground potential or about zero volts.

In alternative embodiments, the emitter 120 may be maintained at ground potential and the target 116 may be maintained at a positive potential with respect to the emitter 120. By way of example, the target 116 may be at a potential of about 140 kV and the emitter 120 may be at ground potential or about zero volts. In some embodiments, a bi-polar target and emitter arrangement may be employed. For example, the emitter 120 may be maintained at a negative potential, the target 116 may be maintained at a positive potential, and a frame to which the emitter 120 and target 116 are secured may be grounded.

When the electron beam 102 impinges upon the target 116, a large amount of heat may be generated in the target 116. The heat generated in the target 116 may be significant enough to melt the target 116. In some embodiments, a rotating target may be used to address the problem of heat generation in the target 116. For example, in some embodiments, the target 116 may be configured to rotate such that the electron beam 102 striking the target 116 does not cause the target 116 to melt since the electron beam 102 does not strike the target 116 substantially continuously at the same location. In some embodiments, the target 116 may include a stationary target. The target 116 may be made of a material that is capable of withstanding the heat generated by the impact of the electron beam 102. For example, the target 116 may include materials such as, but not limited to, tungsten, molybdenum, or copper.

In the illustrated embodiment, the emitter 120 is a flat emitter. In alternative configurations the emitter 120 may be a curved emitter. The curved emitter, which is typically concave in curvature, provides pre-focusing of the electron beam. As used herein, the term "curved emitter" may be used to refer to an emitter that has a curved emission surface. Further, the term "flat emitter" may be used to refer to an emitter that has a flat emission surface. It may be noted that emitters of different shapes or sizes may be employed based on particular requirements for a given application.

In some embodiments, the emitter 120 may be formed from a low work-function material. More particularly, the emitter 120 may be formed from a material that has a high melting point and is capable of stable electron emission at high temperatures. The low work-function material may include materials such as, but not limited to, tungsten, thoriated tungsten, lanthanum hexaboride, hafnium carbide, or the like. In some embodiments, the emitter 120 may be provided with a coating of a low work-function material.

With continuing reference to FIG. 1, the injector 110 of the illustrated embodiments includes an electrode assembly 128 including an emitter focusing electrode 130, an extraction electrode 140, and a downstream focusing electrode 150. In the illustrated embodiments, the emitter focusing electrode 130 is disposed proximate the emitter 120, the extraction electrode 140 is disposed downstream of the emitter focusing electrode 130 and the emitter 120, and the downstream focusing electrode 150 is disposed downstream of the extraction electrode 140, with the extraction electrode 140 thus interposed between the emitter focusing electrode 130 and the downstream focusing electrode 150. The electrode assembly 128, or portions thereof, may be mounted to and/or enclosed by the injector wall 114. The particular geometries or arrangements of electrodes depicted in FIG. 1 are provided by way of example for simplicity and clarity of illustration and may differ in various embodiments. For example, one or more of the electrodes (e.g., the downstream focusing electrode) may have a larger outer diameter than other electrodes (e.g., the emitter focusing electrode and/or extraction electrode) and/or be mounted to an alternative wall or structure than injector wall 114. Also, one or more of the electrodes (e.g., the downstream focusing electrode) may have a greater length along an axis defined by the electron beam than other electrodes (e.g., the emitter focusing electrode and/or extraction electrode). Further, one or more of the electrodes may have a tapered bore, for example, a bore having a larger inner diameter at a downstream end and a smaller inner diameter at an upstream end. (See, e.g., FIG. 8 and related discussion.)

The emitter focusing electrode 130 is disposed proximate to the emitter 120. In the illustrated embodiment, the emitter focusing electrode 130 is positioned such that at least a portion of the emitter focusing electrode 130 overlaps at least a portion of the emitter 120 in the downstream direction 104, with the portion of the emitter focusing electrode 130 that overlaps the emitter 120 disposed axially outward (with the electron beam 102 defining the axis) from the emitter 120 and surrounding the emitter 120 in the axial direction. In some embodiments, the emitter focusing electrode 130 may be disposed immediately downstream of the emitter 120 (e.g., not overlapping in the downstream direction, but either abutting or having a very small gap between the emitter 120 and the emitter focusing electrode 130 in the downstream direction 104). In some embodiments, the emitter focusing electrode is formed as a substantially continuous annular member (e.g., a ring).

In some embodiments, the emitter focusing electrode 130 may be maintained at a voltage potential that is less than a voltage potential of the emitter 120. The potential difference between the emitter 120 and the emitter focusing electrode 130 inhibits the movement of electrons generated from the emitter 120 from moving towards the emitter focusing electrode 130. For example, the emitter focusing electrode 130 may be maintained at a negative potential with respect to that of the emitter 120, with the negative potential with respect to the emitter 120 acting to focus the electron beam 102 away from the emitter focusing electrode 130, thereby facilitating focusing the electron beam 102 towards the target 116.

In some embodiments, the emitter focusing electrode 130 may be maintained at a voltage potential that is equal to or substantially similar to the voltage potential of the emitter 120. The similar voltage potential of the emitter focusing electrode 130 with respect to the voltage potential of the emitter 120 helps generate a substantially parallel electron beam by shaping electrostatic fields due the shape of the emitter focusing electrode 130. The emitter focusing electrode 130 may be maintained at a voltage potential that is equal to or substantially similar to the voltage potential of the emitter 120 via use of a lead (not shown in FIG. 3) that couples the emitter 120 and the emitter focusing electrode 130. Additionally or alternatively, the voltage potential of the emitter focusing electrode 130 may be adjustable between a potential substantially similar to the potential of the emitter 120 and a negative potential with respect to the potential of the emitter 120.

The electrode assembly 128 of the injector 110 further includes an extraction electrode 140 disposed proximate to and downstream of the emitter focusing electrode 130. The extraction electrode 140 is also disposed downstream of the emitter 120 and upstream with respect to the target 116, and is configured to additionally shape, control, and/or focus the electron beam 102. In the illustrated embodiment, the extraction electrode 140 is formed as generally continuous ring shaped member disposed axially outwardly of the emitter 120 and the electron beam 102. In alternate embodiments, other shapes may be employed for the extraction electrode 140 (e.g., elliptical, polygonal, or the like).

In some embodiments, the extraction electrode 140 may be negatively biased with respect to the emitter 120. For example, a bias voltage power supply 142 may supply a voltage to the extraction electrode 140 such that the extraction electrode 140 is maintained at a negative bias voltage with respect to the emitter 120. In some embodiments, the negative bias voltage may be variable. For example, the negative bias voltage may be variable between a maximum amplitude of negative bias voltage and a minimum amplitude of negative bias voltage. The minimum amplitude of negative bias voltage, in some embodiments, may be about zero volts of bias with respect to the voltage of the emitter 120. The bias voltage of the extraction electrode 140 may be adjusted via a control electronics module 144, which may control the bias voltage responsive to an operator input from, for example, an operator console.

Further, in some embodiments, the extraction electrode 140 may also be selectably positively biased with respect to the emitter 120. For example, the bias voltage power supply 142 may supply a voltage to the extraction electrode 140 such that the extraction electrode 140 is maintained at a positive bias voltage with respect to the emitter 120. The electrode assembly 128 may be configured so that an operator may selectably switch between a positive bias voltage and a negative bias voltage for the extraction electrode 140. For example, a number of pre-set voltages may be selectable between a maximum negative bias voltage and a maximum positive voltage bias, or, as another example, the bias voltage may be substantially continuously adjustable between the maximum negative bias voltage and the maximum positive voltage bias (e.g., via use of a dial, slider, or the like on a control panel or operator console).

The electrode assembly 128 of the injector 110 further includes a downstream focusing electrode 150 disposed proximate to and downstream of the extraction electrode 140. In the illustrated embodiment, one downstream focusing electrode 150 is shown. In some embodiments, additional downstream focusing electrodes may be employed. The downstream focusing electrode 150 is thus also disposed downstream of the emitter 120 and upstream with respect to the target 116, and is configured to additionally shape, control, and/or focus the electron beam 102. In the illustrated embodiment, the downstream focusing electrode 150 is formed as generally continuous ring shaped member disposed axially outwardly of the emitter 120 and the electron beam 102. In alternate embodiments, other shapes may be employed for the downstream focusing electrode 150 (e.g., elliptical, polygonal, or the like).

The downstream focusing electrode 150 may be positively biased with respect to the emitter 120. It should be noted that in some embodiments the downstream focusing electrode 150 may additionally be configured to aid in extraction of the electron beam and thus may also be understood as or referred to as a downstream extraction electrode. For example, a bias voltage power supply 152 may supply a voltage to the downstream focusing electrode 150 such that the extraction electrode 140 is maintained at a positive bias voltage with respect to the emitter 120. In some embodiments, the positive bias voltage may be variable. For example, the positive bias voltage may be variable between a maximum amplitude of positive bias voltage and a minimum amplitude of positive bias voltage. The bias voltage of the downstream focusing electrode 150 may be adjusted via a control electronics module 154, which may control the bias voltage responsive to an operator input from, for example, an operator console. For example, a number of pre-set voltages may be selectable between the maximum positive bias voltage and the minimum positive voltage bias, or, as another example, the bias voltage may be substantially continuously adjustable between the maximum positive bias voltage and the minimum positive voltage bias (e.g., via use of a dial, slider, or the like on a control panel or operator console).

Figure 2:
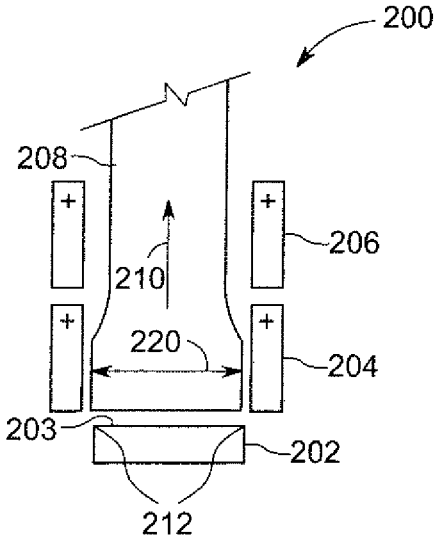
FIG. 2 provides a side schematic view of a maximum size electron beam in accordance with various embodiments.
Figure 3:
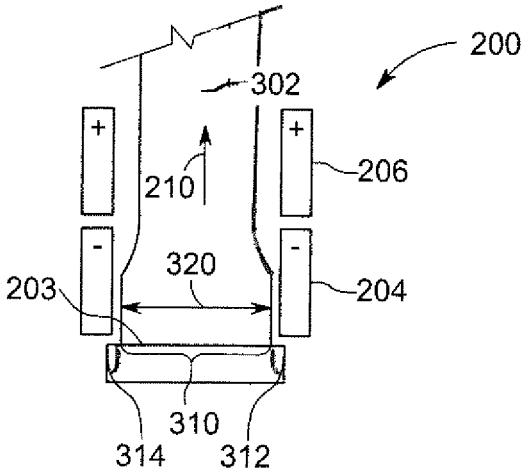
FIG. 3 provides a side schematic view of a reduced size electron beam in accordance with various embodiments.
Figure 4:
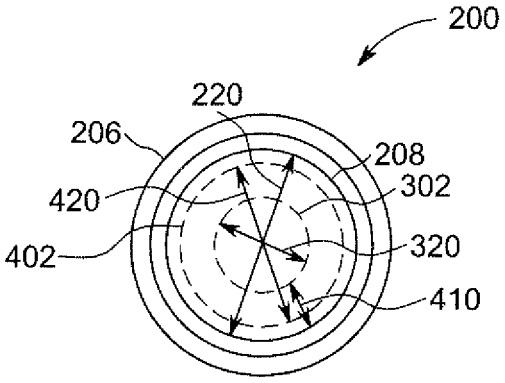
FIG. 4 provides a plan schematic view of variously sized electron beams in accordance with various embodiments.

Various combinations of bias voltages among the electrodes of the electrode assembly 128 and/or magnet voltage or current settings may be employed to vary a size or diameter of the electron beam 102. FIGS. 2-4 schematically depict variously sized electron beams resulting from various combinations of bias voltages of the electrodes of an electrode assembly in accordance with some embodiments. FIG. 2 provides a side (e.g., oriented to see a side view of an electron beam) schematic view of maximum size electron beam 208 in accordance with an embodiment, FIG. 3 provides a side schematic view of a reduced size electron beam 302 in accordance with an embodiment, and FIG. 4 provides a plan (e.g., oriented to see an electron beam as traveling out of the page) schematic view of variously sized electron beams in accordance with an embodiment. The electron beams of FIGS. 2-4 are depicted as having substantially uniform circular cross-sections along the length of the electron beams. In alternative embodiments, electron beams may be tapered uniformly or non-uniformly along all or a portion of a length, and/or may have cross-sectional shapes that are not substantially circular (e.g., substantially oval, substantially polygonal, substantially elliptical, or the like).

In FIG. 2, an X-ray assembly 200 includes an emitter 202, an emitter focusing electrode substantially surrounding the emitter 202 in an axial direction (not shown in FIG. 2), an extraction electrode 204, and a downstream focusing electrode 206. The emitter 202 is configured to emit an electron beam 208 in a downstream direction 210 from an emitter surface 203. The emitter 202 has an available, or maximum, emission area 212 of the emitter surface 203. The maximum emission area 212 corresponds to the largest size or diameter of electron beam that the emitter 202 is capable of emitting or configured to emit. In the illustrated embodiment, the maximum emission area 212 covers substantially all of the emitter surface 203.

In FIG. 2, the extraction electrode 204 and the downstream focusing electrode 206 are both maintained at a positive bias voltage with respect to the emitter 202. For example, in some embodiments the extraction electrode 204 and the downstream electrode 206 may be operated at substantially similar voltages at some point in time, and operated at different voltages at other times. In FIG. 2, the voltages of the extraction electrode 204 and the downstream focusing electrode are set at a positive value (or values) that corresponds to substantially all of the maximum emission area 212 of the emitter 202 being employed to emit electrons, resulting in an electron beam 208 that corresponds to a maximum size of electron beam for the emitter 202.

In FIG. 3, the X-ray assembly 200 of FIG. 2 is once again depicted; however, the bias voltages of one or more of the electrodes of the X-ray assembly 200 have been altered in FIG. 3 from the settings of FIG. 2. In FIG. 3, the extraction electrode 204 has been set to a negative bias voltage with respect to the emitter 202. At the voltage settings of FIG. 3, an electron beam 302 having a smaller cross-section area, width, or diameter than the electron beam 208 of FIG. 2 is produced. The electron beam 302 is emitted from an area of an emission surface of the emitter 202 that is smaller than the maximum emission area 212.

In FIG. 3, the extraction electrode 204 is maintained at a negative bias voltage with respect to the emitter 202, and the downstream focusing electrode 206 is maintained at a positive bias voltage with respect to the emitter 202. In some embodiments the downstream electrode 206 may be operated at a substantially higher magnitude (e.g., absolute value) of voltage than the extraction electrode 204. In FIG. 3, the combination of a negative bias voltage (with respect to the emitter 202) for the extraction electrode 204 and a positive bias voltage for the downstream focusing electrode 206 results in an electron beam 302 having a smaller cross-section than the electron beam 208.

As seen in FIG. 3, the electron beam 302 is emitted from a reduced emission area 310 of the emitter 202. Further, suppression portions 312, 314 of FIG. 3 depict areas of the maximum emission area 212 of the emitter 202 that substantially do not emit electrons. Thus, the diameter 320 of the electron beam 302 of FIG. 3 is reduced from the diameter 220 of the electron beam 208 of FIG. 2. The diameter 320 may be further reduced along the length of the electron beam 302 via a focusing effect from one or more electrodes. The diameter 320 of the electron beam 302 may be adjustable. For example, the diameter 320 of an electron beam may be a minimum beam diameter for the X-ray assembly 200, and the bias voltage of the extraction emitter may have a maximum negative bias voltage amplitude corresponding to the diameter 320 (e.g., the minimum beam diameter) of the electron beam. By reducing the amplitude of the negative bias voltage of the extraction electrode 204 with respect to the emitter 202, the relative size of the suppression portions 312, 314 may be reduced and the diameter (and/or other size such as a width and/or cross-sectional area) of the electron beam increased. Thus, by varying the amplitude of the negative bias voltage of an extraction electrode, the diameter, width, and/or cross-sectional area of an electron beam may be adjusted. In some embodiments, additional adjustability is obtained by adjusting the bias voltage of an extraction electrode between a maximum amplitude positive bias voltage (corresponding to an electron beam having a maximum diameter, width, and/or cross-sectional area for the particular configuration) and a maximum amplitude negative bias voltage (corresponding to an electron beam having a minimum diameter, width, and/or cross-sectional area for the particular configuration).

FIG. 4 provides a plan schematic view of variously sized electron beams produced by the X-ray system 200 corresponding to different electrode bias voltages in accordance with an embodiment. As seen in FIG. 4, the various electron beams are disposed axially inward of the electrodes. In FIG. 4, the extraction electrode 204 (not shown in FIG. 4) and the downstream focusing electrode 206 are similarly sized substantially continuous ring-shaped members centered substantially about the electron beam. The maximum emission area 212 is a circular shaped area corresponding to the emitter surface 203 of the emitter 202.

Three variously sized electron beam diameters are depicted in FIG. 4. The diameter 220 (e.g., of electron beam 208) extends to the edges of the maximum emission area and thus corresponds to a maximum diameter electron beam for the emitter 202. The diameter 220 corresponds to the voltage configuration depicted in FIG. 2. In other embodiments, the maximum diameter electron beam may not cover substantially all of the emitter surface 203. For example, in embodiments where the extraction electrode is configured to be set exclusively at one or more negative bias voltages, the maximum emission area may be disposed axially inward of the outer edges of the emitter surface 203.

The diameter 320 (e.g., of electron beam 302, depicted by a dashed line in FIG. 4) is less than the diameter 220 and corresponds to the voltage configuration depicted in FIG. 3. In the illustrated embodiment, the diameter 320 corresponds to a maximum amplitude of negative bias voltage and thus corresponds to a minimum emission area for the X-ray assembly 200. The suppression area 410 depicts the portion of the maximum emission area 212 from which electrons are substantially prevented from emitting for the formation of the electron beam corresponding to the diameter 320 (e.g., electron beam 302).

In various embodiments, the X-ray assembly 200 may be configured for adjustability of the electron beam size between a maximum size (e.g., electron beam 208) and a minimum size (e.g., electron beam 302). In FIG. 4, an intermediately sized electron beam 402 is depicted by a phantom line. The intermediately sized electron beam has a diameter 420 that is greater than the diameter 320, but less than the diameter 220. For example, the electron beam 402 may be produced by the X-ray assembly 200 with the extraction electrode 204 set at a negative bias voltage having an amplitude less than the amplitude of the negative bias voltage corresponding to the electron beam 302. Thus, in some embodiments, an X-ray system may be configured to produce variably sized electron beams that may be selectably adjusted for a given application or procedure. For example, in an application where a generally higher resolution focal spot may be desired, a generally smaller diameter (or cross-sectional area) electron beam may be produced, while for a different application where a generally lower resolution focal spot may be desired, a generally larger diameter (or cross-section area) electron beam may be produced. In some embodiments, an X-ray system may have predetermined settings corresponding to discrete intervals of voltage or electron beam size. Alternatively or additionally, the X-ray system may be substantially continuously adjustable over a range (e.g., between a maximum beam size and a minimum beam size).

Returning to FIG. 1, it may be noted that, in an X-ray tube, energy of an X-ray beam may be controlled via one or more of a plurality of techniques. For example, the energy of an X-ray beam may be controlled by altering the potential difference (e.g., acceleration voltage) between the cathode (e.g., emitter) and the anode (e.g., target), or by filtering the electron beam. This may be generally referred to as "kV control." The intensity of an X-ray beam may also be controlled via control of the electron beam current. (As used herein, the term "electron beam current" refers to the flow of electrons per second between the cathode and the anode.) Such a technique of controlling the intensity may be generally referred to as "mA control." As discussed herein, aspects of some embodiments provide for control of an electron beam current via one or more electrodes, such as the extraction electrode 140 and/or the downstream focusing electrode 150. It may be noted that the use of such electrodes may enable a decoupling of the control of electron emission from the acceleration voltage or potential difference between the emitter 120 and the target 116.

In some embodiments, the extraction electrode 140 and/or the downstream focusing electrode 150 are configured for microsecond current control. For example, the electron beam current may be controlled on the order of microseconds by altering the voltage applied to one or more of the extraction electrode 140 or the downstream focusing electrode 150 on the order of microseconds. It may be noted the emitter 120 may be treated as an infinite source of electrons. In accordance with aspects of some embodiments, electron beam current, which is typically a flow of electrons from the emitter 120 toward the target 116, may be controlled by altering the voltage potential of one or more of the extraction electrode 140 or the downstream focusing electrode 150. In some embodiments, the size (e.g., width, diameter, cross-sectional area) of an electron beam may be controlled via control of the bias voltage of one or more of the extraction electrode 140 or the downstream focusing electrode 150. Further, in some embodiments, the intensity of the electron beam may also be controlled via control of the bias voltage of one or more of the extraction electrode 140 or the downstream focusing electrode 150.

In some embodiments, the emitter focusing electrode 130 may be maintained at substantially the same voltage as the emitter 120, while the extraction electrode 140 may be biased at a negative voltage with respect to the emitter 120 and the emitter focusing electrode 130. By way of example, the voltage potential of the emitter 120 (as well as the emitter focusing electrode 130) may be about −140 kV, the voltage of the extraction electrode may be maintained at a negative bias to the about −140 kV voltage of the emitter 120, and the downstream focusing electrode 150 may be maintained at about −135 kV or higher to positively bias the downstream focusing electrode 150 with respect to the emitter 120 (as well as the extraction electrode 140). In some embodiments, an electric field 170 is generated between the downstream focusing electrode 150 and the extraction electrode 140 due to the potential difference between the downstream focusing electrode 150 and the extraction electrode 140. The strength of the electric field 170 thus generated may be used to control the intensity of an electron beam generated by the emitter 120 towards the target 116. The intensity of the electron beam 102, for example, may therefore be controlled by controlling the strength of the electric field 170. For instance, the electric field 170 causes the electrons emitted from the emitter 120 to be accelerated towards the target 116. The stronger the electric field 170, the stronger is the acceleration of the electrons from the emitter 120 towards the target 116. Similarly, the weaker the electric field 170, the lesser is the acceleration of electrons from the emitter 120 towards the target 116. Further, a differential between the bias voltage of the extraction electrode 140 and the bias voltage of the downstream focusing electrode 150 may be defined and altered by altering one or more of the bias voltage of the extraction electrode 140 and the bias voltage of the downstream focusing electrode 150. The intensity of the electron beam may be increased as the differential increases, therefore providing for control of intensity of the electron beam by adjusting the voltage differential.

Furthermore, in some embodiments, voltage shifts (e.g., of about 8 kV or less) may be applied to one or more of the extraction electrode 140 or the downstream focusing electrode 150 to control the intensity of the electron beam 102. In some embodiments, these voltage shifts may be applied to the extraction electrode 140 via use of the control electronics module 144 and the downstream focusing electrode 150 via use of the control electronics module 154. The voltage applied to one or more of the extraction electrode 140 or the downstream focusing electrode 150 may be changed in intervals from about 1-15 microseconds to intervals of about at least 150 milliseconds. In some embodiments, the control electronics modules 144, 154 may include Silicon (Si) switching technology circuitry to change the voltage applied to one or more of the extraction electrode 140 or the downstream focusing electrode 150. In some embodiments, where the voltage shifts may range beyond 8 kV, a silicon carbide (SiC) switching technology may be applied. Changes in voltage applied to one or more of the extraction electrode 140 or the downstream focusing electrode 150 thus may facilitate changes in intensity of the electron beam 102 in intervals of about 1-15 microseconds, for example. The control of the intensity of the electron beam on the order of microseconds may be referred to as microsecond intensity switching.

The X-ray tube assembly 100 depicted in FIG. 1 also includes a magnetic assembly 160 for focusing and/or positioning and deflecting the electron beam 102 on the target 116. In some embodiments, the magnetic assembly 160 may be disposed between the injector 110 and the target 116 (e.g. downstream of the extraction electrode 140, downstream of the downstream focusing electrode 150, and upstream of the target 116). In the illustrated embodiment, the magnetic assembly 160 includes magnets 162 for influencing focusing of the electron beam 102 by creating a magnetic field that shapes the electron beam 102 on the target 116. The magnets 162 may include or more quadrupole magnets, on or more dipole magnets, or combinations thereof. As the properties of the electron beam current and voltage may change rapidly, the effect of space charge and electrostatic focusing in the injector 110 will change accordingly. To help maintain a stable focal spot size, or quickly modify focal spot size according to system requirements, the magnetic assembly 160 in some embodiments provides a magnetic field having a performance controllable from steady-state to a sub-30 microsecond time scale for a wide range of focal spot sizes. In some embodiments, the magnetic assembly 160 may be configured to provide a magnetic field having a performance controllable from steady-state to a sub-10 microsecond time scale. This helps provide protection of the X-ray source system, as well as achieving CT system performance requirements.

Further, in some embodiments, the magnetic assembly 160 may include one or more dipole magnets for deflection and positioning of the electron beam 102 at a desired location on the X-ray target 116. The electron beam 102 that has been focused and positioned impinges upon the target 116 to generate the X-rays 180. The X-rays 180 generated by collision of the electron beam 102 with the target 116 may be directed from the X-ray tube 118 through an opening in the tube casing 118, which may be generally referred to as an X-ray window 164, towards an object (not shown in FIG. 1.)

The electrons in the electron beam 102 may get backscattered after striking the target 116. Therefore, the X-ray tube assembly 100 may include an electron collector 166 for collecting electrons that are backscattered from the target 116. In some embodiments, the electron collector 166 may be maintained at a ground potential. In some embodiments, the electron collector 166 may be maintained at a potential that is substantially similar to the potential of the target 116. The electron collector 166 may be located proximate to the target 116 to collect the electrons backscattered from the target 116. The electron collector 166 may be located between the emitter 120 and the target 116 (e.g. downstream of the emitter 120 and upstream of the target 116), and, in some embodiments, may be disposed closer to the target 116 than to the extraction electrode 140. The electron collector 166 may be formed from a refractory material, such as, but not limited to, molybdenum. As another example, the electron collector 166 may be formed from copper. In still another embodiment, the electron collector 166 may be formed from a combination of a refractory metal and copper.

In some embodiments, the X-ray tube assembly 100 may include a positive ion collector (not shown) to attract positive ions that may be produced due to collision of electrons in the electron beam 102 with the target 116. The positive ion collector is generally placed along the electron beam path and prevents the positive ions from striking various components in the X-ray tube assembly 100.

Figure 5:
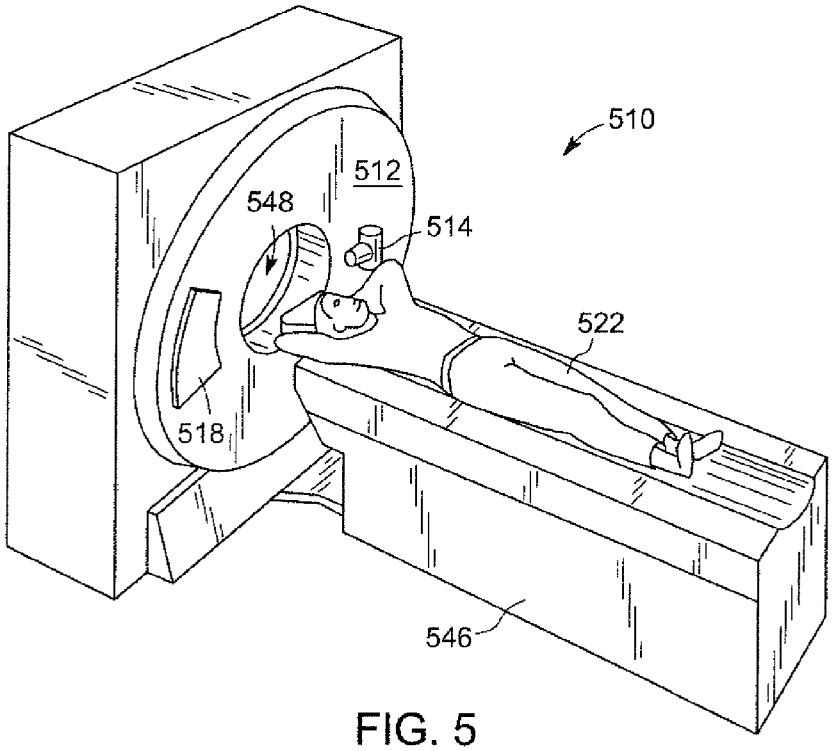
FIG. 5 is a pictorial view of a computed tomography (CT) imaging system in accordance with various embodiments.
Figure 6:
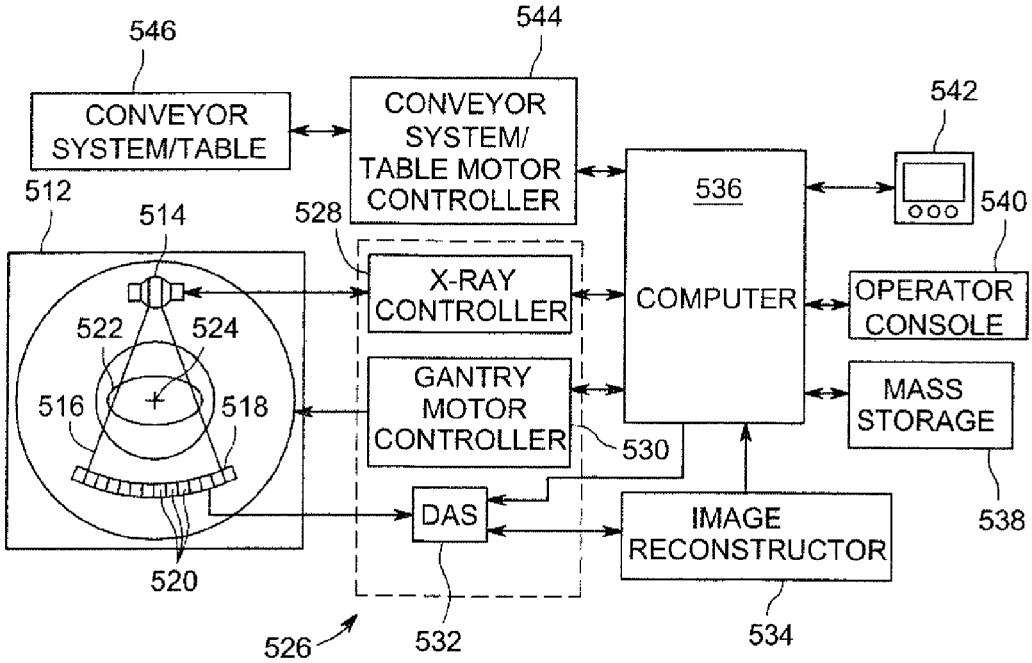
FIG. 6 is a block schematic diagram of the CT imaging system of FIG. 5 in accordance with various embodiments.

An X-ray assembly, such as the X-ray tube assembly 100, formed in accordance with various embodiments, may be used in conjunction with a computed tomography (CT) system. FIG. 5 provides a pictorial view of a computed tomography (CT) imaging system 510 in accordance with an embodiment, and FIG. 6 provides a block schematic diagram of the CT imaging system 510 of FIG. 5 in accordance with various embodiments. The CT imaging system 510 includes a gantry 512. The gantry 512 has an X-ray source 514 configured to project a beam of X-rays 516 toward a detector array 518 positioned opposite the X-ray source 514 on the gantry 512. The X-ray source 514 may include an X-ray tube assembly such as the X-ray tube assembly 100. In some embodiments, the gantry 512 may have multiple X-ray sources (e.g., along a patient theta or patient Z axis) that project beams of X-rays. The detector array 518 is formed by a plurality of detectors 520 which together sense the projected X-rays that pass through an object to be imaged, such as a medical patient 522. During a scan to acquire X-ray projection data, the gantry 512 and the components mounted thereon rotate about a center of rotation 524. While the CT imaging system 510 is described in connection with FIG. 5 with reference to the medical patient 522, it should be noted that the CT imaging system 510 may have applications outside of the medical realm. For example, the CT imaging system may 510 may be utilized for ascertaining the contents of closed articles, such as luggage, packages, etc., and in search of contraband such as explosives and/or biohazardous materials.

Rotation of the gantry 512 and the operation of the X-ray source 514 are governed by a control mechanism 526 of the CT system 510. The control mechanism 526 includes an X-ray controller 528 that provides power and timing signals to the X-ray source 514 and a gantry motor controller 530 that controls the rotational speed and position of the gantry 512. A data acquisition system (DAS) 532 in the control mechanism 526 samples analog data from the detectors 520 and converts the data to digital signals for subsequent processing. An image reconstructor 534 receives sampled and digitized X-ray data from the DAS 532 and performs high-speed reconstruction. The reconstructed image is applied as an input to a computer 536, which stores the image in a mass storage device 538.

Moreover, the computer 536 may also receive commands and scanning parameters from an operator via operator console 540 that may have an input device such as a keyboard (not shown in FIGS. 5 and 6). An associated display 542 allows the operator to observe the reconstructed image and other data from the computer 536. Commands and parameters supplied by the operator are used by the computer 536 to provide control and signal information to the DAS 532, the X-ray controller 528, and the gantry motor controller 530. Additionally, the computer 536 may operate a table motor controller 544, which controls a motorized table 546 to position the patient 522 and/or the gantry 512. For example, the table 546 may move portions of the patient 522 through a gantry opening 548. It may be noted that in certain embodiments, the computer 536 may operate a conveyor system controller 544, which controls a conveyor system 546 to position an object, such as baggage or luggage, and the gantry 512. For example, the conveyor system 546 may move the object through the gantry opening 548.

In some embodiments, the operator console 540 is configured to allow an operator to vary or adjust the size (e.g., diameter, width, and/or cross-sectional area) of an electron beam produced and used by an X-ray tube to produce an X-ray. For example, a controller (e.g., the X-ray controller 528) may, responsive to an operator input, vary the bias voltage of one or more of an extraction electrode (e.g., extraction electrode 140) or downstream focusing electrode (e.g., downstream focusing electrode 150) to alter an emission area from an emitter (e.g., emitter 120), thereby altering the electron beam size, and thereby altering the focal spot size. The operator may be provided with predetermined settings corresponding to particular voltages, electron beam sizes, and/or focal spot sizes, and/or an operator may substantially continuously adjust one or more settings using a dial, slider, keypad, touchscreen, or the like. In some embodiments, an operator may enter a particular procedure or application at the operator console 540, and voltage settings for the extraction electrode and/or downstream focusing electrode may be automatically selected by a processor of the CT scanning system 510 to provide an appropriate electron beam size and/or focal spot size for the particular procedure or application. As another example, the operator may input, for example, a bias voltage for the extraction electrode and/or the downstream focusing electrode, a desired electron beam size, and/or a desired focal spot size.

Figure 7:
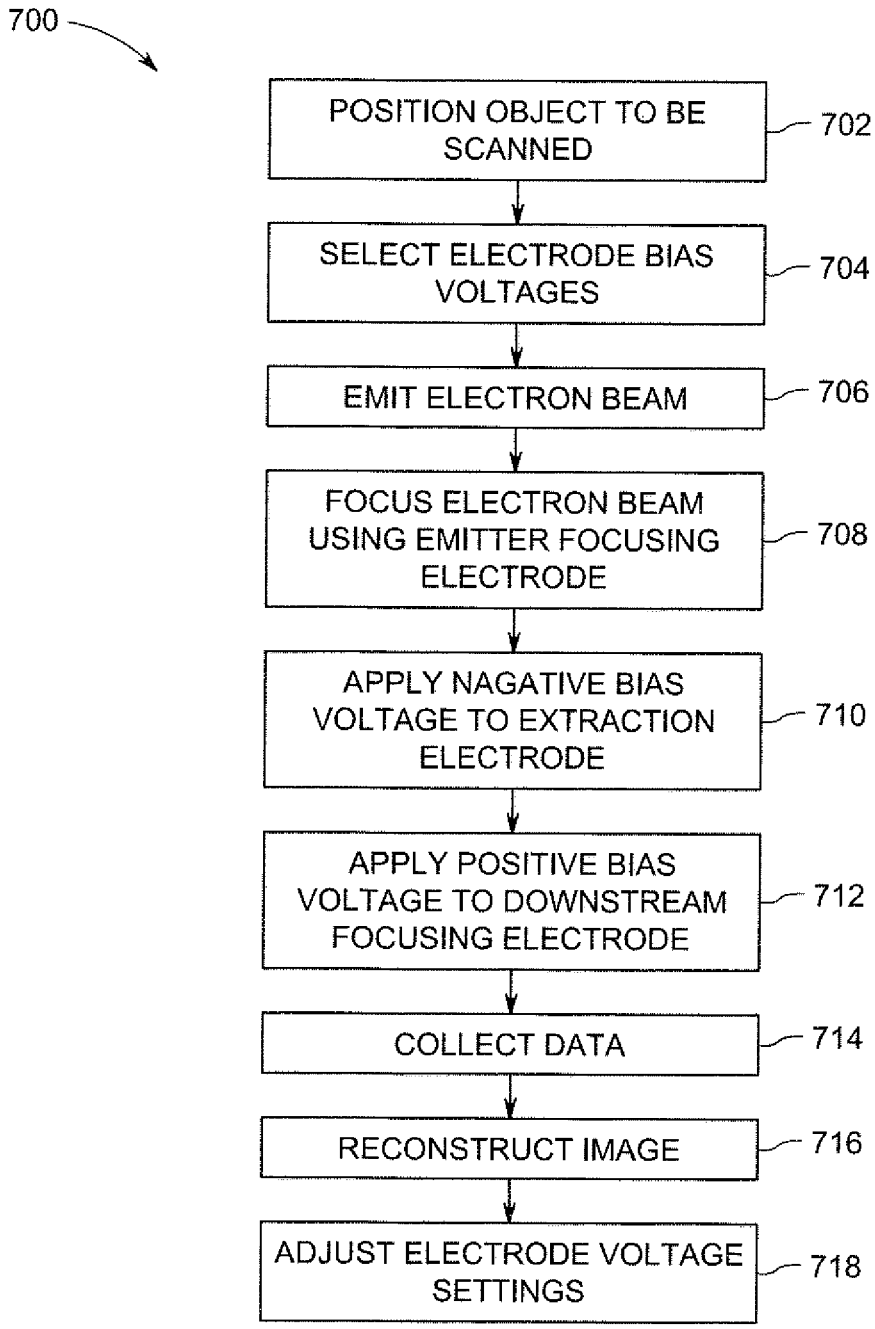
FIG. 7 is a flowchart of an exemplary method for performing an X-ray scan in accordance with various embodiments.

FIG. 7 is a flow chart of a method 700 for performing an X-ray scan in accordance with an embodiment. The method 700, for example, may employ structures or aspects of various embodiments discussed above. In various embodiments, certain steps may be omitted or added, certain steps may be combined, certain steps may be performed simultaneously, or concurrently, certain steps may be split into multiple steps, certain steps may be performed in a different order, or certain steps or series of steps may be re-performed in an iterative fashion.

At 702, an object to be scanned is positioned. For example, in some embodiments, the object may be a patient placed on a bed or table that is advanced through a gantry for performing a CT scan. As another example, in some embodiments the object may be a piece of luggage or a package that is placed on a conveyor belt and advanced to a scanning location.

At 704, electrode bias voltages are selected. Bias voltages for one or more of an emitter focusing electrode (e.g., emitter focusing electrode 130), an extraction electrode (e.g., extraction electrode 140), or a downstream focusing electrode (e.g., downstream focusing electrode 150) may be selected. In some embodiments, one or more bias voltages may be selected directly or indirectly by an operator via an input entered at an operator console. For example, an operator may indirectly select one or more bias voltages by specifying a desired focal spot size, a desired electron beam diameter (or other size), or a particular procedure or application for which a processing unit is configured to select appropriate electrode bias voltages. In some embodiments, an operator console may present predetermined settings to an operator (e.g., via prompts provided on a touchscreen or otherwise). As another example, an operator may directly enter one or more bias voltages. Additionally or alternatively, one or more bias voltages may be adjustable substantially continuously between a maximum and minimum setting (e.g., corresponding to maximum and minimum electron beam sizes). In some embodiments, the bias voltage of the extraction electrode may be set to a negative bias voltage relative to the emitter voltage, and the bias voltage of the downstream focusing electrode may be set to a positive bias voltage relative to the emitter voltage.

At 706, an electron beam is emitted from an emitter (e.g., emitter 120). For example, an emitter (from which electrons are emitted) may be maintained at a negative voltage with respect to a target (toward which electrons are directed). For example, the target may be maintained at a positive voltage (e.g., about 140 kV) and the emitter maintained at about 0 V. As another example, the target may be maintained at about 0 V, and the emitter maintained at about −140 kV. The emitter may be heated directly or indirectly. As the electron beam proceeds downstream from the emitter toward the target, the electron beam proceeds through the extraction electrode and the downstream focusing electrode.

At 708, the electron beam is focused using an emitter focusing electrode (e.g., emitter focusing electrode 130). The emitter focusing electrode may be, for example, a substantially continuous ring-shaped member disposed proximate to and at least partially surrounding (in an axial direction) the emitter. In some embodiments, the emitter focusing electrode may be maintained at substantially the same voltage as the emitter, which may result in an electron beam having substantially parallel edges. In some embodiments, the emitter focusing electrode may be maintained at a negative bias voltage with respect to the emitter.

At 710, a negative bias voltage is applied to the extraction electrode. For example, the negative bias voltage may have been selected at 704. The extraction electrode may be a substantially ring-shaped member centered about the electron beam emitted from the emitter. In some embodiments, the extraction electrode is disposed proximately to the emitter focusing electrode, and is disposed downstream of the emitter focusing electrode. The extraction electrode may be disposed by a relatively small gap downstream of the emitter focusing electrode.

At 712, a positive bias voltage is applied to the downstream focusing electrode. For example, the positive bias voltage may have been selected at 704. The downstream focusing electrode may be a substantially ring-shaped member centered about the electron beam emitted from the emitter. In some embodiments, the downstream focusing electrode is disposed proximately to the extraction electrode, and is disposed downstream of the extraction electrode. The downstream focusing electrode may be disposed by a relatively small gap downstream of the extraction electrode. In some embodiments, the combination of a selected negative bias voltage for the extraction electrode and a positive bias voltage for the downstream focusing electrode results in the inhibition or suppression of the emission of electrons from a portion of the emitter, resulting in a reduced emission area and a smaller size (e.g., width, diameter, and/or cross-sectional area of an electron beam).

At 714, imaging data is collected or acquired during the performance of the scan. For example, a gantry including an X-ray source and associated components may rotate about an object being scanned, while a detector array (e.g., detector array 518) senses the projected X-rays that pass through the object. In other embodiments, imaging data may be collected while an object, such as a package or luggage is advanced by a scanning area on a conveyor belt, carrousel, or other device. In still other embodiments, a scanning device and object being scanned may remain substantially stationary with respect to each other during a scan.

At 716, an image is reconstructed using the imaging data collected at 714. In some embodiments, an image reconstructor (e.g., image reconstructor 534) may receive sampled and digitized X-ray data and perform a high-speed reconstruction.

At 718, one or more settings of the electrodes are adjusted. For example, an initial scan of an object may reveal a portion of the scan for which additional, more detailed information is desired. The scanning system may be adjusted to have a higher resolution focal spot (e.g. by increasing an amplitude of negative bias voltage with respect to the emitter of the extraction electrode to reduce a size of an electron beam emitted by the emitter) for a more detailed scan of the portion of interest. As another example, if after reconstruction of the image it is determined that the image is of insufficient resolution, the scanning system may be adjusted to have a higher resolution and the scan re-performed to provide a higher-resolution image. As yet another example, one or more bias voltages may be adjusted to perform a scan corresponding to a new or different application or procedure of scan to be performed on a different object than the object that was previously imaged. As still another example, the scanning system may have a default setting, and the bias voltages of the electrodes may be adjusted to return to the default setting after successful scanning and/or imaging of an object. Further still, adjustments may be made to one or more of the bias voltages to change a voltage differential between the extraction electrode and the downstream focusing electrode, whereby a field between the extraction electrode and downstream focusing electrode may be altered to adjust an intensity of the electron beam. Thus, in some embodiments, both the intensity and the size of the electron beam may be adjusted.

Figure 8:
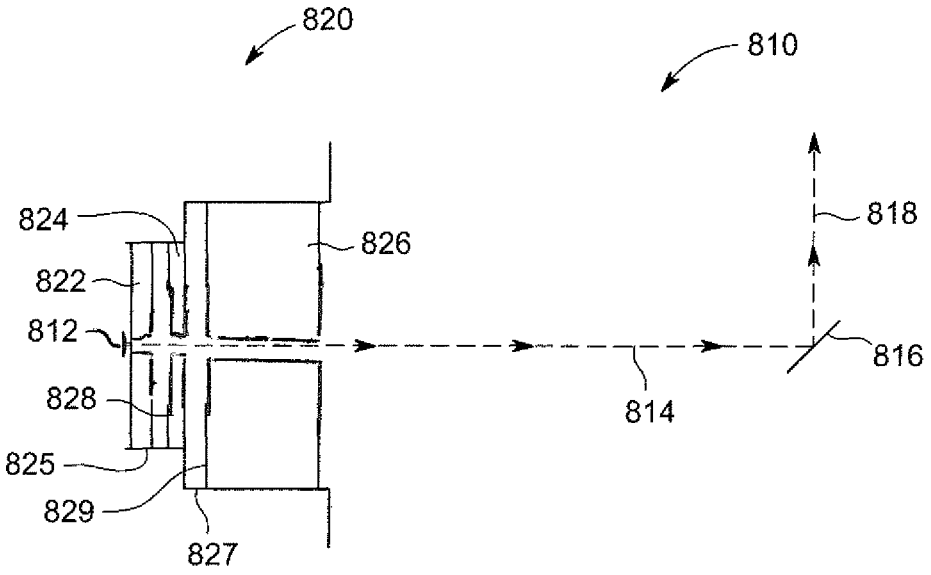
FIG. 8 is a side schematic view of an X-ray tube assembly in accordance with various embodiments.

FIG. 8 is a schematic view of an X-ray tube assembly 810 formed in accordance with an embodiment. The X-ray tube assembly 810 includes an emitter 812 configured to emit an electron beam 814 toward a target 816. The X-ray tube assembly 810 also includes an electrode assembly 820 configured to focus or otherwise direct, shape, or influence the electron beam 814 as the electron beam 814 proceeds in a downstream direction from the emitter 812 to the target 816. The target 816 emits an X-ray beam 818 responsive to the impingement of the electron beam 814 upon the target 816. The emitter 812 may be maintained at a negative voltage potential with respect to the target 816 so that electrons emitted from the emitter 812 flow toward the target 816.

In the illustrated embodiment, the electrode assembly 820 includes an emitter focusing electrode 822, an extraction electrode 824, and a downstream focusing electrode 826. In the illustrated embodiment, each of the emitter focusing electrode 822, extraction electrode 824, and downstream focusing electrode 826 are substantially cylindrical, or ring-shaped in cross-section, and configured to surround an axis defined by the electron beam 814 in an axial direction. In the illustrated embodiment, the emitter focusing electrode 822 is disposed proximate the emitter 812 (in some embodiments the emitter focusing electrode 822 may overlap the emitter 812 in the downstream direction), the extraction electrode 824 is disposed downstream of the emitter 812 and the emitter focusing electrode 822, and the downstream focusing electrode 826 is disposed downstream of the extraction electrode 824. In various embodiments, one or more of the emitter focusing electrode 822, extraction electrode 824, and downstream focusing electrode 826 are provided with or maintained at a bias voltage with respect to the emitter 812 to control the shape or other feature of the electron beam 814 as the electron beam 814 progresses from the emitter 812 past the electrode assembly 820 in the downstream direction.

In the illustrated embodiment, the emitter focusing electrode 822 and the extraction electrode 824 are mounted to a first wall 825 of the X-ray tube assembly 810, and the downstream focusing electrode 826 is mounted to a second wall 827 of the X-ray tube assembly 810. In the illustrated embodiment, the depicted electrodes include substantially straight, or flat, bores. In some embodiments, one or more of the electrodes (or a portion thereof) may include a sloped bore, for example, such that the inner diameter of the electrode increases in the downstream direction. As shown in FIG. 1, the extraction electrode 824 and the downstream focusing electrode 826 of the illustrated embodiment include upstream walls, 828, 829, respectively, that are substantially perpendicular to the axis defined by the electron beam 814. In some embodiments, the downstream focusing electrode 826 may be substantially larger in the downstream direction and/or in an axial direction than the extraction electrode 824, and/or may be configured to be maintained at a bias voltage having a substantially larger amplitude than a bias voltage of the extraction electrode. In various embodiments, other arrangements may be employed. For example, more or fewer numbers of electrodes may be employed, different mountings may be employed, and different geometries of electrodes may be employed. In some embodiments, one or more electrodes may define a polygonal cross-section with an opening therethrough instead of a ring-shaped structure as discussed above. As another example, the upstream wall of one or more electrodes may be tapered or sloped with respect to the axis defined by the electron beam.

Thus, embodiments provide systems and methods wherein an electron beam size and focal spot size associated with an X-ray system may be adjusted. For example, a size of an electron beam may be reduced to provide a high resolution focal spot. Also, the size of an electron beam for a given X-ray tube assembly may be varied or adjusted by an operator of a scanning device or system including the X-ray tube, allowing one scanning device or system to perform a variety of scans using different resolution focal spots. Thus, some embodiments provide for improved adjustability of electron beam sizes, and/or improved resolution, for example, for X-ray imaging.

It should be noted that the various embodiments may be implemented in hardware, software or a combination thereof. The various embodiments and/or components, for example, the modules, or components and controllers therein, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as a solid state drive, optical drive, and the like. The storage device may also be other similar means for loading computer programs or other instructions into the computer or processor.

As used herein, the term "computer", "controller", and "module" may each include any processor-based or microprocessor-based system including systems using microcontrollers, reduced instruction set computers (RISC), application specific integrated circuits (ASICs), logic circuits, GPUs, FPGAs, and any other circuit or processor capable of executing the functions described herein. The above examples are exemplary only, and are thus not intended to limit in any way the definition and/or meaning of the term "module" or "computer."

The computer, module, or processor executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer, module, or processor as a processing machine to perform specific operations such as the methods and processes of the various embodiments described and/or illustrated herein. The set of instructions may be in the form of a software program. The software may be in various forms such as system software or application software and which may be embodied as a tangible and non-transitory computer readable medium. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program. The individual components of the various embodiments may be virtualized and hosted by a cloud type computational environment, for example to allow for dynamic allocation of computational power, without requiring the user concerning the location, configuration, and/or specific hardware of the computer system.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments, and also to enable any person skilled in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

What is claimed is:

1. An X-ray tube assembly comprising:

an emitter configured to emit an electron beam defining a downstream direction toward a target, the emitter disposed proximate an upstream end of the X-ray tube assembly, the emitter defining a maximum emission area from which the electron beam may be emitted from the emitter;

an emitter focusing electrode disposed proximate the emitter and outward of the emitter in an axial direction;

an extraction electrode disposed proximate the emitter focusing electrode, the extraction electrode disposed downstream of the emitter and the emitter focusing electrode, the extraction electrode configured to surround the electron beam in the axial direction, the extraction electrode having a negative bias voltage setting wherein the extraction electrode has a negative bias voltage with respect to the emitter at the negative bias voltage setting; and a downstream focusing electrode disposed proximate the extraction electrode and downstream of the extraction electrode, the downstream focusing electrode configured to surround the electron beam in the axial direction, the downstream focusing electrode having a positive bias voltage with respect to the emitter;

wherein, when the extraction electrode is at the negative bias voltage setting, the electron beam is emitted from an emission area that is smaller than the maximum emission area.

2. An assembly in accordance with claim 1, wherein an amplitude of the negative bias voltage of the extraction electrode is adjustable, the emission area being reduced as the amplitude of the negative bias voltage of the extraction electrode is increased for a given emitted current.

3. An assembly in accordance with claim 1, wherein the extraction electrode has a positive voltage bias setting at which the extraction electrode has a positive bias voltage with respect to the emitter.

4. An assembly in accordance with claim 3, wherein an amplitude of the positive bias voltage of the extraction electrode is adjustable, the emission area being increased as the amplitude of the positive bias voltage of the extraction electrode is increased.

5. An assembly in accordance with claim 4, wherein the amplitude of the positive bias voltage of the extraction electrode is adjustable to a maximum emission positive voltage bias corresponding to the maximum emission area of the emitter.

6. An assembly in accordance with claim 1, further comprising a control module operably connected to the extraction electrode, the control module configured to adjust an amplitude of the negative bias voltage responsive to an operator input.

7. An assembly in accordance with claim 1, wherein a differential between an extraction bias voltage of the extraction electrode and a downstream focusing bias voltage of the downstream focusing electrode is adjustable, whereby an intensity of the electron beam is increased as the differential is increased.

8. An assembly in accordance with claim 1, wherein the emitter focusing electrode, extraction electrode, and downstream focusing electrode are configured as substantially annular rings.

9. An X-ray tube assembly comprising:

an emitter configured to emit an electron beam defining a downstream direction, the emitter disposed proximate an upstream end of the X-ray tube assembly;

a target disposed proximate a downstream end of the X-ray tube assembly and configured to receive the electron beam emitted from the emitter, the target configured to provide an X-ray beam responsive to a collision of the electron beam with the target;

an emitter focusing electrode disposed proximate the emitter and outward of the emitter in an axial direction;

an extraction electrode disposed proximate the emitter focusing electrode, the extraction electrode disposed downstream of the emitter and the emitter focusing electrode, the extraction electrode configured to surround the electron beam in the axial direction, the extraction electrode having a negative bias voltage setting wherein the extraction electrode has a negative bias voltage with respect to the emitter at the negative bias voltage setting, the extraction electrode having a positive voltage bias setting wherein the extraction electrode has a positive bias voltage with respect to the emitter at the positive bias voltage setting, the extraction electrode configured to be movable between the negative bias voltage setting and the positive bias voltage setting;

a downstream focusing electrode disposed proximate the extraction electrode and downstream of the extraction electrode, the downstream focusing electrode configured to surround the electron beam in the axial direction, the downstream focusing electrode having a positive bias voltage with respect to the emitter;

wherein the electron beam is emitted from a first emission area when the extraction electrode is at the positive bias voltage setting and is emitted from a second emission area when the extraction electrode is at the negative bias voltage setting, wherein the first emission area is larger than the second emission area; and a focusing magnet assembly disposed downstream of the downstream focusing electrode and upstream of the target, the focusing magnet assembly configured to at least one of focus, deflect, or position the electron beam on the target.

10. An assembly in accordance with claim 9, wherein an amplitude of the negative bias voltage of the extraction electrode is adjustable, the emission area being reduced as the amplitude of the negative bias voltage of the extraction electrode is increased for a given emitted current.

11. An assembly in accordance with claim 9, wherein an amplitude of the positive bias voltage of the extraction electrode is adjustable, the emission area being increased as the amplitude of the positive bias voltage of the extraction electrode is increased.

12. An assembly in accordance with claim 11, wherein the emitter defines a maximum emission area from which the electron beam may be emitted from the emitter, and wherein the amplitude of the positive bias voltage of the extraction electrode is adjustable to a maximum emission positive voltage bias corresponding to the maximum emission area of the emitter.

13. An assembly in accordance with claim 9, further comprising a control module operably connected to the extraction electrode, the control module configured to adjust an amplitude of at least one of the negative bias voltage or the positive bias voltage responsive to an operator input.

14. An assembly in accordance with claim 9, wherein a differential between an extraction bias voltage of the extraction electrode and a downstream focusing bias voltage of the downstream focusing electrode is adjustable, whereby an intensity of the electron beam is increased as the differential is increased.

15. An assembly in accordance with claim 9, wherein the emitter focusing electrode, extraction electrode, and downstream focusing electrode are configured as substantially annular rings.

16. An assembly in accordance with claim 9, further comprising an electron collector disposed downstream of the emitter and upstream of the target.

17. A method for providing an electron beam, the method comprising:

emitting an electron beam defining a downstream direction from an emitter toward a target, the emitter defining a maximum emission area from which the electron beam may be emitted from the emitter;

focusing the electron beam using an emitter focusing electrode disposed proximate to the emitter;

applying a negative bias voltage to an extraction electrode through which the electron beam passes, the negative bias voltage having a negative voltage with respect to the emitter, the extraction electrode disposed proximate the emitter focusing electrode, the extraction electrode disposed downstream of the emitter and the emitter focusing electrode, the extraction electrode configured to surround the electron beam in the axial direction; and applying a positive bias voltage to a downstream focusing electrode, the positive bias voltage having a positive voltage with respect to the emitter, the downstream focusing electrode disposed downstream of the extraction electrode, the downstream focusing electrode configured to surround the electron beam in the axial direction;

wherein, when the extraction electrode is at the negative bias voltage setting, the electron beam is emitted from an emission area that is smaller than the maximum emission area.

18. A method in accordance with claim 17, further comprising adjusting an amplitude of the negative bias voltage to vary a size of the emission area, wherein the emission area is reduced as the amplitude of the negative bias voltage is increased.

19. A method in accordance with claim 17, wherein the extraction electrode has a negative voltage bias setting wherein the extraction electrode has the negative bias voltage with respect to the emitter and a positive voltage bias setting wherein the extraction electrode has a positive bias voltage with respect to the emitter at the positive bias voltage setting, the method further comprising moving the extraction electrode from one of the negative voltage bias setting or the positive voltage bias setting to the other of the negative voltage bias setting or the positive voltage bias setting.

20. A method in accordance with claim 19, further comprising adjusting the positive bias voltage of the extraction electrode to vary a size of the emission area, wherein the emission area is increased as the amplitude of the positive bias voltage of the extraction electrode is increased.

21. A method in accordance with claim 20, further comprising adjusting the amplitude of the positive bias voltage of the extraction electrode to a maximum emission positive voltage bias corresponding to the maximum emission area of the emitter.

22. A method in accordance with claim 17, further comprising adjusting a differential between an extraction bias voltage of the extraction electrode and a downstream focusing bias voltage of the downstream focusing electrode, whereby an intensity of the electron beam is increased as the differential is increased.

* * * * *